US007733235B2

(12) United States Patent
Baker et al.

(10) Patent No.: US 7,733,235 B2
(45) Date of Patent: Jun. 8, 2010

(54) WIRELESS SMOKE AND FIRE DETECTION SYSTEM AND METHOD

(76) Inventors: Herbert Baker, 7901 State Rd., Philadelphia, PA (US) 19136; Shawnfatee M. Bridges, Graterford Rd. and Perkiomen Creek Rd., Graterford, PA (US) 19426; Derrick U. Hall, Graterford Rd. and Perkiomen Creek Rd., Graterford, PA (US) 19426; Joseph J. Kindler, Graterford Rd. and Perkiomen Creek Rd., Graterford, PA (US) 19426

( * ) Notice: Subject to any disclaimer, the term of this patent is extended or adjusted under 35 U.S.C. 154(b) by 400 days.

(21) Appl. No.: 11/927,886

(22) Filed: Oct. 30, 2007

(65) Prior Publication Data

US 2009/0109016 A1 Apr. 30, 2009

(51) Int. Cl.
*G08B 17/00* (2006.01)

(52) U.S. Cl. ..... 340/628; 340/506; 340/539.27; 340/577; 340/539.1

(58) Field of Classification Search ..... 340/539.27, 340/578–579, 581, 628, 573, 524, 501
See application file for complete search history.

(56) References Cited

U.S. PATENT DOCUMENTS 4,363,031 A * 12/1982 Reinowitz ..... 340/539.26
5,587,705 A 12/1996 Morris
5,831,526 A * 11/1998 Hansler et al. ..... 340/539.14
5,898,369 A 4/1999 Goodwin
5,914,674 A 6/1999 Coleman et al.
6,078,269 A 6/2000 Markwell et al.
6,133,839 A 10/2000 Ellul, Jr. et al.
6,420,973 B2 7/2002 Acevedo
6,529,128 B2 * 3/2003 Weng ..... 340/539.1
6,624,570 B1 9/2003 Marman et al.
6,700,496 B2 3/2004 Francke et al.
6,759,896 B2 6/2004 Ford
6,759,956 B2 7/2004 Menard et al.
6,762,686 B1 7/2004 Tabe
6,829,478 B1 12/2004 Layton et al.
6,831,557 B1 12/2004 Hess
7,015,807 B2 * 3/2006 Roby et al. ..... 340/531
2004/0207551 A1 10/2004 Vining
2004/0212493 A1 10/2004 Stilp
2005/0040943 A1 2/2005 Winick
2005/0195088 A1 * 9/2005 Solak ..... 340/628

* cited by examiner

*Primary Examiner*—Daniel Wu
*Assistant Examiner*—Son M Tang
(74) *Attorney, Agent, or Firm*—Woodcock Washburn LLP

(57) ABSTRACT

A smoke detector system employs smoke detectors that enter a "lockout period" following receipt of an alarm signal, during which time a detector will not receive a RF alarm signal and will not transmit a RF alarm signal after a certain period of time if that detector does not detect, or no longer detects, a dangerous condition. The lockout period is of sufficient duration to prevent re-transmission of a RF alarm signal by a detector even though it may have received a RF alarm signal from another detector(s). Hence, after a short period of time, no RF alarm signals will be received or transmitted and each detector resets, unless a dangerous condition is detected.

5 Claims, 5 Drawing Sheets

WIRELESS SMOKE AND FIRE DETECTION SYSTEM AND METHOD

FIELD OF ENDEAVOR

The present invention is generally directed to a wireless, radio frequency (RF), smoke and fire detection and alarm system, and in particular to an improvement therein for preventing certain types of false alarms.

BACKGROUND

Wireless, radio frequency (RF) smoke and fire detection and alarm systems are well known. In such systems, each of a plurality of smoke and fire detector and alarm units (hereinafter "detectors") is capable of alerting a building occupant of a dangerous (i.e., smoke or fire) condition even if the occupant is not in proximity to the detector detecting the dangerous condition. These systems work by relaying wireless, RF, alarm signals between the detectors so as to cause the alarms in all of the detectors to sound and thereby alert occupants of the existence of the dangerous condition, even if it is in a remote area from the occupant's location.

For example, a house may have one detector in each of the basement, first and second floors. Should a fire occur in the basement, the basement detector detecting that condition both sounds an internal alarm and transmits an RF alarm signal. Another detector, say the first floor detector, sounds its own internal alarm when it receives the RF alarm signal from the basement detector, and also retransmits the RF alarm signal. The second floor detector sounds its internal alarm upon receiving the RF alarm signal (from either the basement or first floor detector) and also re-transmits the RF alarm signal.

Prior art detectors continue sounding their internal alarms even if the condition causing the alarm has abated until manually turned off. This can be annoying to the occupants and may defeat the purpose for which the system was installed if the occupants ignore the alarm. It also wastes energy, and in the case of battery powered detectors, results in shortened battery life.

One reason that the detectors may continue to sound their internal alarms, even after the dangerous condition has abated, is due to lingering transmissions of the RF alarm signal. For example, in the scenario described above, the basement detector sent a RF alarm signal which was received by either (or both) of the first and second floor detectors. One or both of the first and second floor detectors then re-transmitted RF alarm signals. However, even after the fire in the basement abated, the first and/or second floor detectors may still be in an alarm state, and hence may re-transmit a RF alarm signal. This may occur indefinitely, causing all of the detectors to sound their internal alarms even though the fire has been abated. Only manual shutdown can alleviate the problem.

SUMMARY OF THE INVENTION

The detectors embodying the present invention overcome the problem described above by going into a "lockout period" following receipt of an alarm signal, during which time a detector will not receive an RF alarm signal and will only transmit RF alarm signal for a short delay period and will not again transmit an RF alarm signal after a certain period of time if that detector does not detect, or no longer detects, a dangerous condition. The lockout period is of sufficient duration to prevent re-transmission of a RF alarm signal by a detector even though it may have received a RF alarm signal from another detector(s). Hence, after a short period of time, no RF alarm signals will be received or transmitted and each detector resets, unless a dangerous condition is detected.

DETAILED DESCRIPTION OF ILLUSTRATIVE EMBODIMENTS

Figure 1:
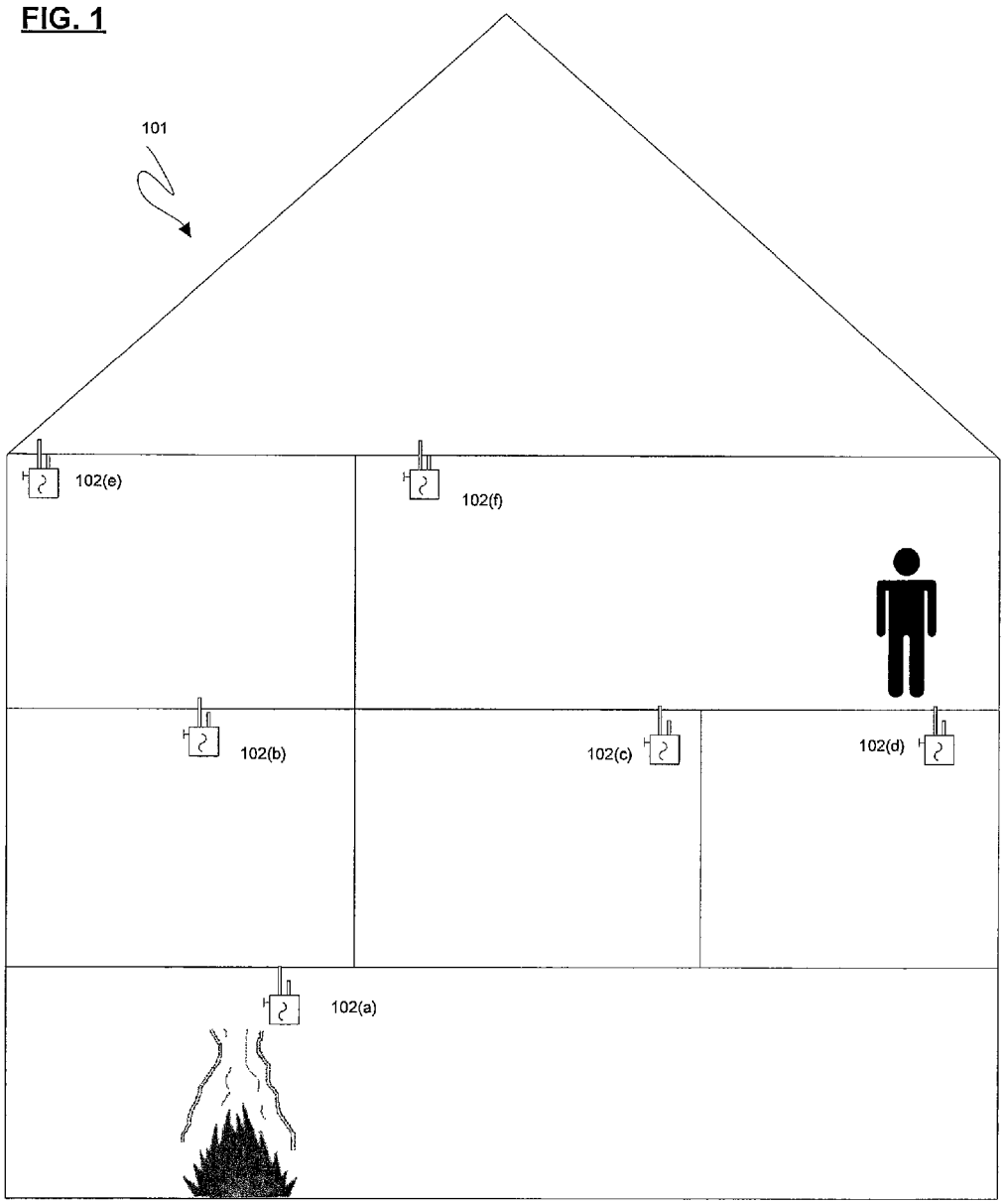
FIG. 1 illustrates a dwelling having a wireless RF smoke and fire detection system.

Turning now to the figures, wherein like numerals represent like elements, FIG. 1 shows a dwelling 101 having a wireless RF smoke and fire detection system comprising a plurality of detectors 102(*a*), (*b*), (*c*), etc. Detectors 102 may be placed in different rooms on different floors to provide maximum coverage for the dwelling. The detectors 102 are designed in well known fashion to detect a dangerous condition, such as smoke or fire. If a smoke or fire condition occurs in the room in which one of the detectors 102 is located then that detector will detect this condition and set off an internal alarm. The alarm may include means for generating sound and/or light.

If detector 102(*a*) detects a dangerous condition, it sets off its alarm and will begin transmitting RF alarm signals. For example, detector 102(*f*) may not detect the dangerous condition that detector 102(*a*) detects, but detector 102(*f*) may receive the RF alarm signal, either directly from detector 102(*a*), or from one of the other detectors that re-transmitted it in response to its/their receipt of the RF alarm signal from detector 102(*a*). When detector 102(*f*) receives the RF alarm signal it will set off its own alarm and begin transmitting RF alarm signals as well. In this manner, all of the detectors will set off their respective alarms and the occupants will be notified of the existence of the dangerous condition, even if the dangerous condition is in a remote room.

Figure 2:
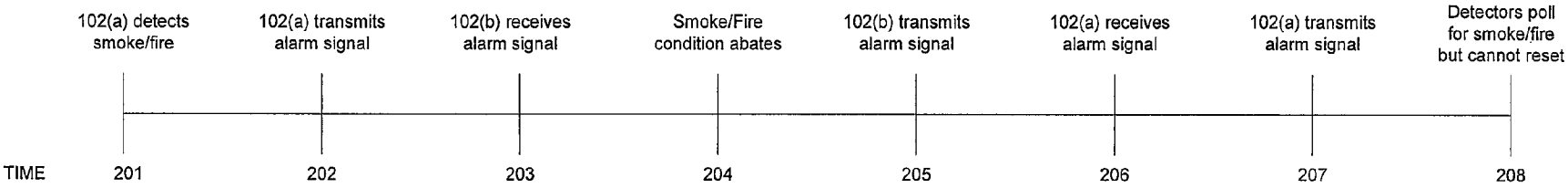
FIG. 2 is a timeline illustrating the RF alarm signal re-transmission problem of prior art wireless RF smoke and fire detection systems.

The timeline of FIG. 2 depicts how the false alarms described in the Background may occur. At time 201, detector 102(*a*) detects a dangerous condition, such as a fire. At time 202, detector 102(*a*) transmits an RF alarm signal. At time 203, a second detector 102(*b*) receives the RF alarm signal and sets off its alarm. At time 204, the fire condition abates. At time 205, the second detector 102(*b*) transmits an RF alarm signal in response to receiving the RF alarm signal from the detector 102(*a*). At time 206, detector 102(*a*) receives the alarm signal from detector 102(*b*) and maintains its alarm in an on state. At time 207, detector 102(*a*) transmits a RF alarm signal in response to receiving a RF alarm signal from another detector. At time 208, detector 102(*a*) and detector 102(*b*) carry out polling to determine the existence of a dangerous condition. Neither detector will detect a dangerous condition, but detector 102(*b*) will not reset because it had received a RF alarm signal from detector 102(*a*) transmitted at time 207. Detector 102(*a*) may attempt to reset, but will eventually receive a RF alarm signal from detector 102(*b*), transmitted from detector 102(*b*). Thus, there is a continuous transmission of RF alarm signals throughout the detector system, such that neither detector is able to reset, even though the dangerous condition has abated. This condition is sometimes referred to as a "continuous loop" in this specification.

Figure 3:
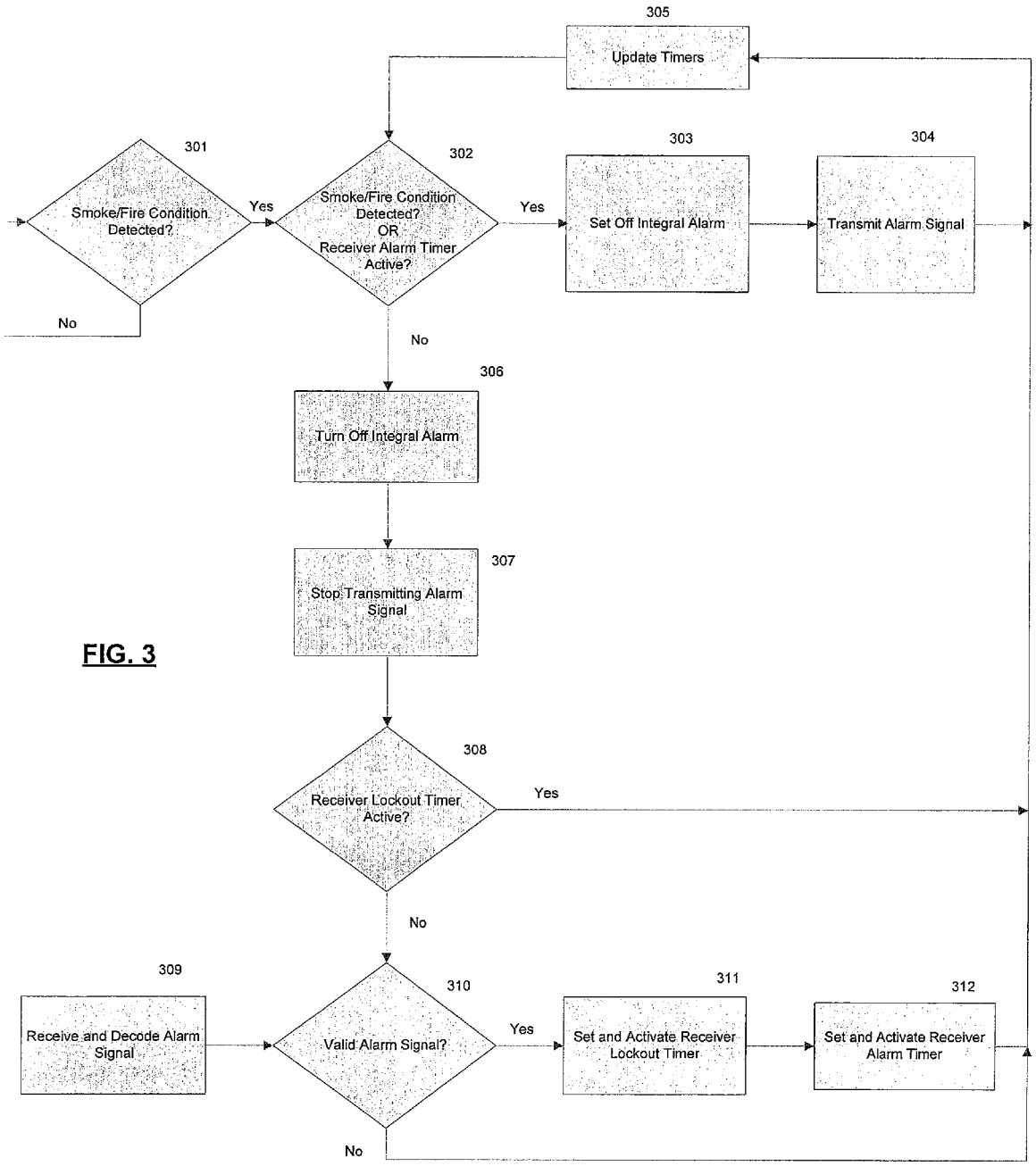
FIG. 3 is a flow chart illustrating the operation of a detector and detector system according to a preferred embodiment of the invention.

Referring to FIG. 3, each detector 102 periodically polls for the presence of a dangerous condition, as shown at 301. If a dangerous condition is detected, then the detector that sensed the dangerous condition will set off its alarm, as shown at 303. The same detector then begins transmitting RF alarm signals for receipt by the other detectors, as shown at 304. Alarm signals are typically transmitted in short bursts periodically. The detector 102 will then continue polling for smoke or fire at 302 after updating all timers at 305.

If a detector(s) receives the RF alarm signal transmitted at 309, the receiving detector(s) decodes the signal at 309 and checks the validity of the signal, as shown at 310. If the signal is not valid, it is ignored and the detector resumes its standard polling cycle. If the signal is valid, the detector will set and activate the Receiver Lockout Timer for the "lockout period" at 311 and the Receiver Alarm Timer for the "transmission period" at 312. The detector then updates all of its timers at 305. Next, the detector polls for a smoke or fire condition at 302 and also checks if the Receiver Alarm Timer is active at 302. Because the Receiver Alarm Timer is now active and the transmission period has not ended, the receiving detector activates its integral alarm at 303 and transmits alarm signals at 304. Thus, for the length of the transmission period the detector will be transmitting alarm signals periodically, but not receiving any. The timers are then decremented at 305. This cycle continues until the Receiver Alarm Timer is decremented to "0," in which case the transmission period has ended and the Receiver Alarm Timer is no longer active. At this point, the detector will move to step 306 after polling because the Receiver Alarm Timer is no longer active. At 306, the integral alarm is turned off and transmission is prevented at 307. The detector then checks to see if the lockout period has ended at 308. If it has not, and the Receiver Lockout Timer is still active, receipt of signals is still prevented because the detector moves to 305 to update the timers, rather than checking for the receipt of alarm signals. Once the lockout period ends and the Receiver Lockout Timer is no longer active, the detector will be able to move to step 310 and receive and handle incoming alarm signals. Thus, false alarms are prevented because the detector will not be receiving any new alarm signals while the lockout period is active, which occurs once a valid alarm signal is received.

Typically, the "lockout period" will be longer than the timer setting for the Receiver Alarm Timer. This allows the detector to prevent transmission and receipt of alarm signals for at least as long as the alarm is going off. These timers may be adjustable however.

Figure 4:
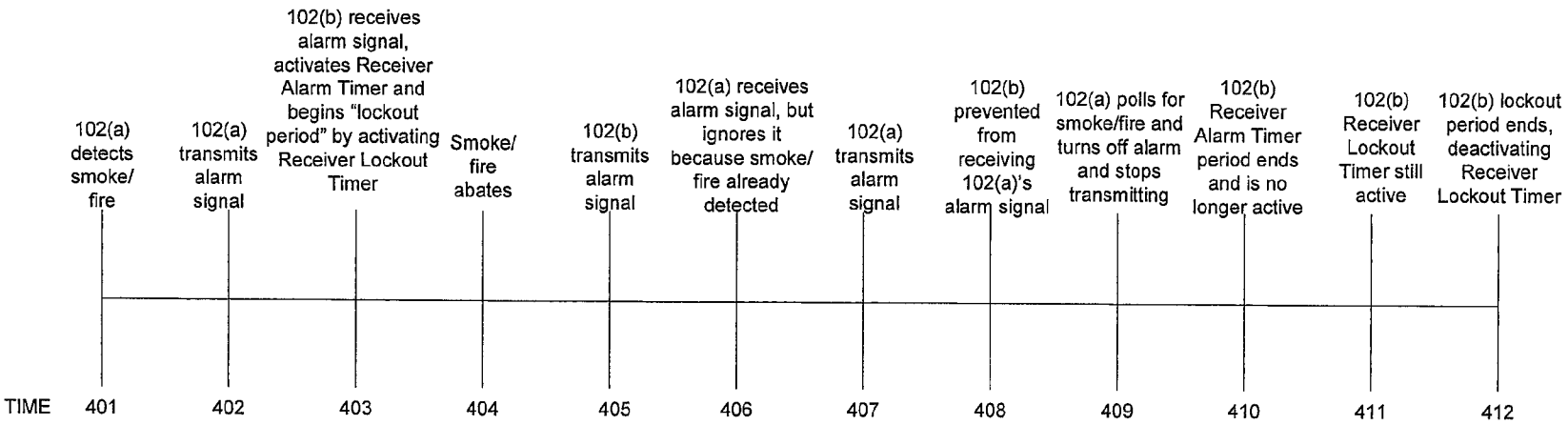
FIG. 4 is a timeline illustrating the operation of a detector and the detection system of the present invention once a dangerous condition abates.

The timeline of FIG. 4 further depicts the foregoing operation in a simple two detector system. At time 401, detector 102(*a*) detects a dangerous condition, such as a fire. At time 402 detector 102(*a*) sets off its alarm and transmits an RF alarm signal. At time 403, detector 102(*b*) receives the RF alarm signal transmitted by detector 102(*a*) and sets off its own alarm. At time 403, detector 102(*b*) also actives the Receiver Alarm Timer and the Receiver Lockout Timer, activating the lockout period, wherein no alarm signals are received by the detector. At time 404, the fire condition abates. At time 405, detector 102(*b*) transmits an RF alarm signal in response to receiving the RF alarm signal transmitted by detector 102(*a*). At time 406, detector 102(*a*) would have received the RF alarm signal transmitted by detector 102(*b*), but ignores the signal because it has already detected a smoke/fire condition. At time 407, detector 102(*a*) transmits an RF alarm signal because a smoke/fire condition was previously detected. At time 408, detector 102(*b*) would have received the RF alarm signal transmitted by detector 102(*a*), but is prevented from doing so because the receiver is locked out. At time 409, detector 102(*a*) polls for the presence of the fire condition. Because the fire condition has abated, detector 102(*a*) will no longer detect a fire condition at time 409, and will subsequently stop transmitting alarm signals and turn off its integral alarm. At time 410 detector 102(*b*) will turn off its integral alarm and cease transmitting RF alarm signals because the Receiver Alarm Timer is no longer activated after its timer has fully decremented. At time 411, detector 102(*b*) is still in its "lockout period," and will thus not receive any incoming alarm signals. This allows any lingering alarm signals sent by detector 102(*a*) to dissipate and leave the system. At time 412, the "lockout period" ends for detector 102(*b*) and the Receiver Lockout Timer is deactivated. At this point both detector 102(*a*) and 102(*b*) are able to receive RF alarm signals, but there are no lingering alarm signals left in the system to set off a false alarm. Now, both detectors have been reset, no alarm is set off, and there are no RF alarm signals being transmitted or received.

Figure 5:
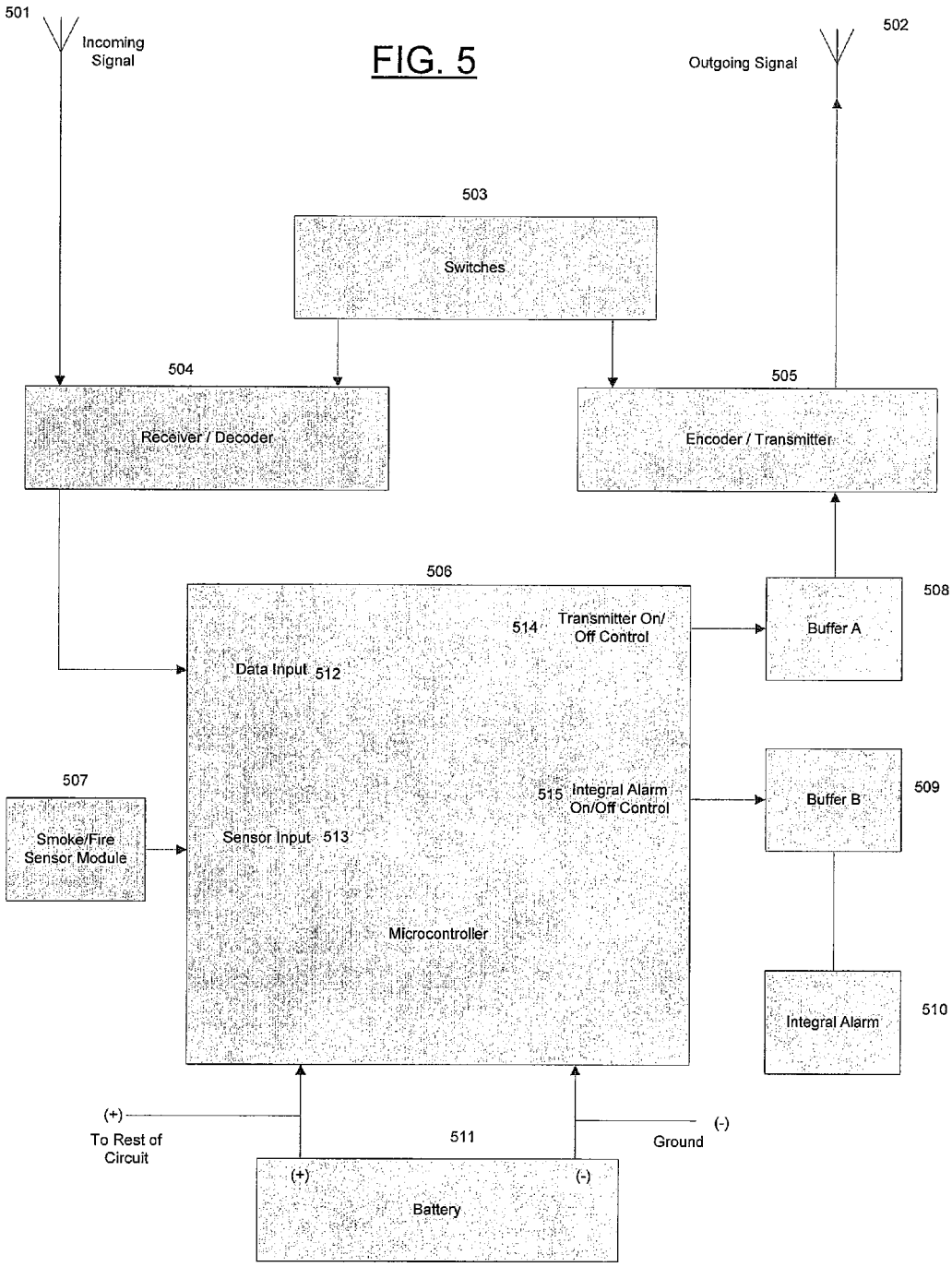
FIG. 5 is a block diagram of the relevant portion of a detector according to the present invention

FIG. 5 is a block diagram of the relevant portions of the detector. Incoming alarm signals enter through an antenna 501 and move to the receiver 504 where they are decoded. The receiver 504 determines if the incoming signal is valid. If so, a valid high is sent from the receiver 504 to the data input portion 512 of the microcontroller 506. If the receiver lockout timer is active and the lockout period is in place, this input will be ignored as described above. If the lockout timer is not active, however, the input will be accepted and the appropriate timers will be activated as described above. The smoke/fire module 507 checks for smoke or fire conditions in the area. If one is detected, short pulses may be sent from the smoke/fire module 507 to the sensor input 513 of the microcontroller 506, alerting the microcontroller 506 of the condition. The microcontroller may turn on the integral alarm in response to either detecting a smoke/fire condition through the smoke/fire sensor module 507 or by receiving an incoming alarm signal. In one embodiment the integral alarm consists of an integral alarm piezosiren 510. The integral alarm 510 may also consist of lights or a number of other alerting devices. Through the Integral Alarm On/Off Control 515, the microcontroller may instruct Buffer B 509 to power on the integral alarm 510. The microcontroller 506 may use the Transmitter On/Off Control 514 to power the transmitter/encoder 505 through Buffer A 508. The transmitter 505 encodes an alarm signal and sends it to other detectors via the outgoing signal antenna 502. A battery 511 powers the entire detector. Buffer A 508 and Buffer B 509 may be used if the microcontroller 506 is unable to directly power the transmitter 505 and/or the integral alarm 510.

Many detector systems of the general type described herein communicate with, and/or operate under the control of, a local, central controller. However, in the absence of the present invention, if the central controller malfunctions or fails, the interconnecting wiring is damaged, or one of the detectors is damaged, one or more of the other detectors may also fail to function. However, implementation of the present invention allows each of the detectors to continue to function independently of the others.

It should be understood that the foregoing description and the embodiments are merely illustrative of the many possible implementations of the present invention and are not intended to be exhaustive.

What is claimed is:

1. In a RF wireless alarm system having a plurality of detectors for detecting smoke or fire, wherein, in operation, each detector detects the presence of smoke or fire and provides an alert in response thereto from an integral alarm, transmits a wireless alarm signal in response to detecting smoke or fire, receives alarm signals transmitted by other detectors and provides the alert from the integral alarm in response thereto, and transmits alarm signals in response to receipt of alarm signals from another detector, a method comprising:

discontinuing receipt of any alarm signal from any detector for a lockout period, after a first detector has received a transmitted alarm signal;

transmitting alarm signals from the first detector for a period of time after the first detector received a transmitted alarm signal;

discontinuing transmission of alarm signals from the first detector, and again receiving and transmitting the alarm signal from the first detector if the alarm signal is received from a second detector after the lockout period has expired; and during the lockout period, any detector that initiated the alarm signal is able to discontinue transmission of its alarm signal if the smoke or fire condition causing the transmission of the alarm signal from the detector has abated, without responding to alarm signals from the first detector that would otherwise cause alarm signal transmission from the initiating detector when no detector senses a smoke or fire condition.

2. The method of claim 1 wherein the transmission period is shorter than the lockout period.

3. The method of claim 1 wherein the transmission period ends before the lockout period ends.

4. The method of claim 1 wherein the lockout period is adjustable.

5. The method of claim 1 wherein the transmission period is adjustable.

* * * * *